US005984012A

United States Patent [19]

Wactor et al.

[11] Patent Number: 5,984,012

[45] Date of Patent: Nov. 16, 1999

[54] EMERGENCY RECOVERY SYSTEM FOR USE IN A SUBSEA ENVIRONMENT

[75] Inventors: John D. Wactor; Richard C. Barnett, both of Houston, Tex.

[73] Assignee: Cooper Cameron Corporation, Houston, Tex.

[21] Appl. No.: 09/042,608

[22] Filed: Mar. 16, 1998

[51] Int. Cl.[6] ..... E21B 43/36

[52] U.S. Cl. ..... 166/364; 166/365; 405/195.1

[58] Field of Search ..... 166/363, 364, 166/365, 339; 405/195.1

[56] References Cited

U.S. PATENT DOCUMENTS

| | | | |
|---|---|---|---|
| 1,189,864 | 7/1916 | Paulson . | |
| 1,636,447 | 7/1927 | Standish . | |
| 1,696,053 | 12/1928 | Pasini . | |
| 2,594,702 | 4/1952 | Woodard | 177/385 |
| 2,722,019 | 11/1955 | Brock | 9/8.3 |
| 2,752,615 | 7/1956 | Parker | 9/9 |
| 3,211,223 | 10/1965 | Hoch | 166/364 |
| 4,182,584 | 1/1980 | Panicker et al. | 405/195 |
| 4,417,830 | 11/1983 | Shotbolt | 405/169 |
| 4,848,970 | 7/1989 | Hunter et al. | 405/195.1 X |
| 5,007,769 | 4/1991 | Legris et al. | 405/195.1 |
| 5,146,990 | 9/1992 | Ritter, Jr. | 166/364 X |
| 5,743,354 | 4/1998 | Hunter | 405/195.1 X |

*Primary Examiner*—Frank Tsay
*Attorney, Agent, or Firm*—Jackie Lee Duke

[57] ABSTRACT

An emergency recovery system designed for use in a subsea environment is disclosed. The emergency recovery system has a casing that is open at each end with a shackle connected to one end of the casing with the opposite end of the shackle designed for connection to appropriate points on the main stack and lower marine riser package in any orientation. A flexible sling with a closed loop formed at each end is used with one of the closed loops releasably connected to the shackle and the end of the casing. The other end of the sling has a flotation member attached to the sling adjacent the closed loop. The sling is fan folded as it is lowered into the casing. The flotation member is shaped to fit inside the other end of the casing with the closed end loop of the sling protruding from the casing. A split retaining ring is placed around the sling between the flotation member and the closed loop and inserted in the open end of the casing. A release ring is inserted through the wall of the casing into the split retaining ring. The flotation member is constructed of syntactic foam and sized to provide sufficient buoyancy to fully extend the sling when the release ring is released by a remotely operated vehicle in a subsea environment.

7 Claims, 4 Drawing Sheets

EMERGENCY RECOVERY SYSTEM FOR USE IN A SUBSEA ENVIRONMENT

BACKGROUND OF THE INVENTION

1. Field of the Invention

This invention relates to a system that facilitates recovery of blowout preventer stacks, subsea trees and similar structures used in oil and gas drilling operations in a subsea environment. The blowout preventer stack connects to the subsea wellhead located on the ocean floor. These blowout preventer stacks are part of a pressure control system used in offshore oil and gas drilling operations to control unexpected well bore pressure spikes or "kicks" as they are commonly referred to in the industry.

The typical subsea blowout preventer stack has a plurality of blowout preventers positioned in a predetermined vertical arrangement or "stack" depending on well conditions and the preferences of the drilling contractor. Each blowout preventer has a vertical bore sized to allow passage of casing, drill pipe, drill bits and downhole tools. A typical subsea "stack" will include both ram-type and annular blowout preventers. Additionally, the stack will include a support frame to facilitate handling during deployment operations and as a support for other components including a control system, kill and choke lines and associated valves and piping.

The typical subsea blowout preventer stack is built and handled in two sections, a lower section known as the "main stack" and an upper section known as the "lower marine riser package." In normal operation, the blowout preventer stack is lowered to the ocean floor and retrieved to the surface using either the drilling riser or a purpose built tool for use with drill pipe. These blowout preventer stacks represent a considerable investment to the drilling contractor and it is important that a damaged stack be retrieved if at all possible. If a malfunction occurs that prevents retrieval of the stack in the usual manner, an emergency recovery system is needed. Most emergency recovery systems currently used require the deployment of special tools or grappling lines.

Problems associated with these current systems include difficulty in use depending on the extent of damage to the blowout preventer stack and causing additional damage to the blowout preventer stack during these recovery operations, especially when grappling lines are used. Similar problems occur during recovery of subsea trees.

2. Description of Related Art

U.S. Pat. No. 1,189,864 to J. C. Paulson shows a device for locating and raising sunken vessels, particularly submarines. The device requires either compressed air or manual manipulation by a person on the submarine for activation.

A submarine detection float is disclosed in U.S. Pat. No. 1,636,447 to T. L. Standish. This apparatus uses a hand wheel activated release mechanism to deploy a float with an air line for sending air to persons trapped in a submarine.

U.S. Pat. No. 1,696,053 to J. Pasini discloses an automatically released buoy when a ship sinks to aid in location and recovery of the sunken ship.

U.S. Pat. No. 2,594,702 to S. W. Woodard discloses a retrievable marine marker that utilizes a geophone activated by an explosion to release a locator buoy.

An apparatus for automatically releasing a submerged buoy after a predetermined period of submersion is shown in U.S. Pat. No. 2,722,019 to A. T. Brock.

U.S. Pat. No. 2,752,615 to L. L. Parker discloses a marker buoy for use in recovering missiles from under water. A water soluble tablet is used to activate the buoy release mechanism.

SUMMARY OF THE INVENTION

The emergency recovery system is designed for use with typical blowout preventer stacks and trees currently used in a subsea environment. The emergency recovery system has a housing or casing that is open at each end. A shackle is connected to one end of the casing with the opposite end of the shackle designed for connection to appropriate points on the main stack and lower marine riser package in a vertical orientation. In a typical installation, the main stack would have four of the emergency recovery systems attached at appropriate points while the lower marine riser package would have two. A flexible sling with a closed loop formed at each end is used with one of the closed loops releasably connected to the shackle and the end of the casing. The other end of the sling has a flotation member attached to the sling adjacent to the closed loop. The sling is fan folded as it is lowered into the casing. The flotation member is shaped to fit inside the other end of the casing with the closed end loop of the sling protruding from the casing. A split retaining ring is placed around the sling between the flotation member and the closed loop and inserted in the open end of the casing. A release ring is inserted through the wall of the casing into the split retaining ring. The flotation member is constructed of syntactic foam and sized to provide sufficient buoyancy to fully extend the sling when the release ring is released by a remotely operated vehicle in a subsea environment.

A principal object of the present invention is to provide an emergency recovery system for blowout preventer stacks and subsea trees that is compact and reliable.

Another object of the present invention is to provide an emergency recovery system that requires no diver intervention for proper operation.

A further object of the present invention is to provide an emergency recovery system that is easily adaptable to radio controlled operation.

A final object of the present invention is to provide an emergency recovery system that will cause minimal damage to the structure being recovered.

These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENT

Figure 1A:
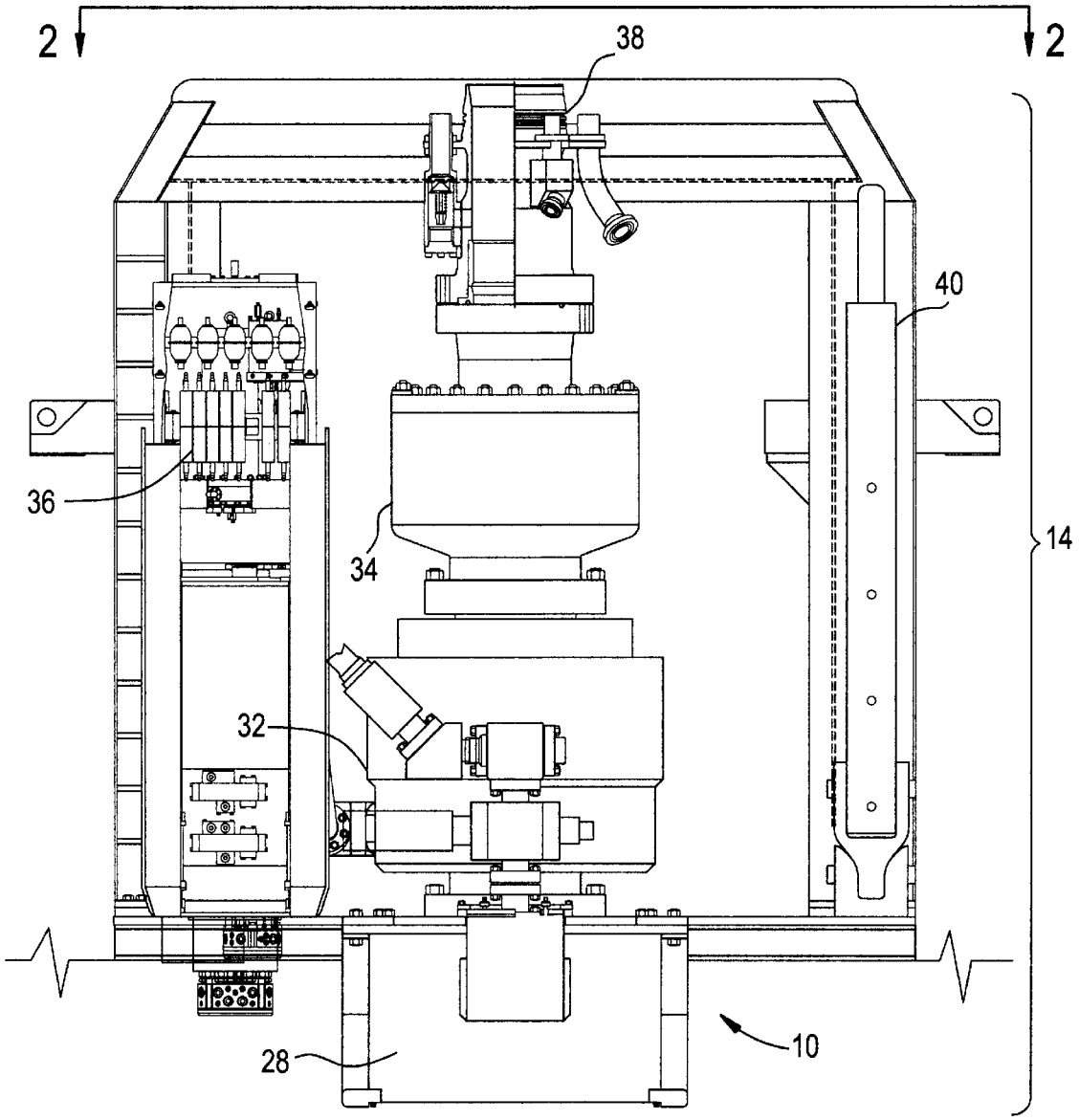
FIGS. 1A and 1B are an elevation view of a blowout preventer stack used in oil and gas drilling operations with the emergency recovery system of the present invention installed.
Figure 1B:
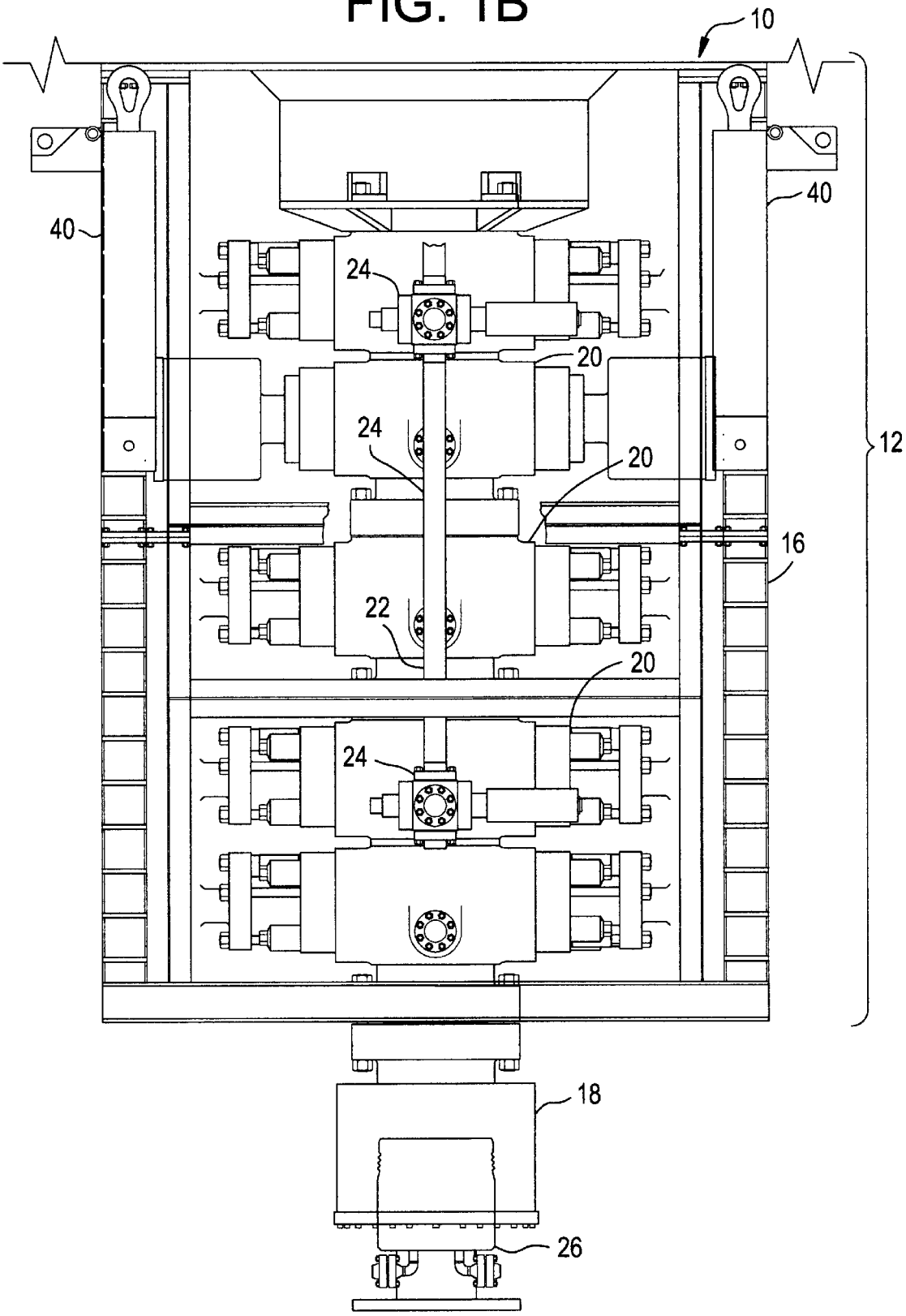

With reference to the drawings, and particularly to FIGS. 1A and 1B, an elevation view of a blowout preventer stack 10 used in subsea oil and gas drilling operations is shown. The blowout preventer stack 10 includes a lower section or main stack 12 and an upper section or lower marine riser package 14. Main stack 12 will be familiar to those of ordinary skill in the art and includes an outer frame 16, lower hydraulic connector 18, ram type blowout preventers 20, kill and choke lines 22 and kill and choke valves 24. Blowout preventer stack 10 is secured to test stump 26 by lower hydraulic connector 18.

Figure 2:
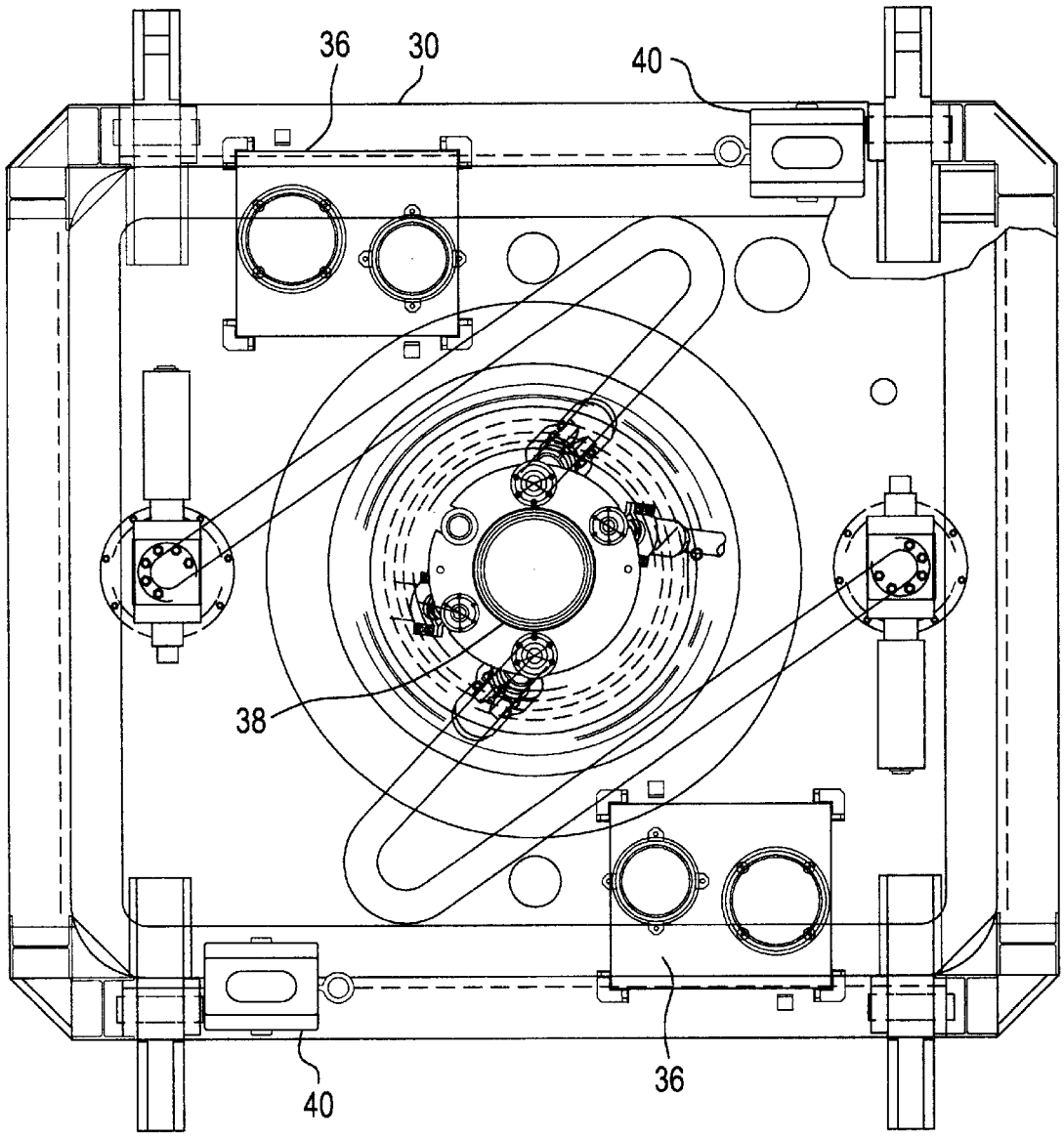
FIG. 2 is a plan view of the lower marine riser package with the emergency recovery system of the present invention installed.

Lower marine riser package 14 is secured to main stack 12 by hydraulic connector 28. Lower marine riser package 14 includes support frame 30, annular blowout preventer 32, flexjoint 34, control system 36 and riser adapter 38. Emergency recovery systems 40 of the present invention are located on main stack 12 and lower marine riser package 14 as shown. FIG. 2 is a plan view of lower marine riser package 14 with emergency recovery systems 40 positioned as shown for ease of accessibility by a remotely operated vehicle.

Figure 3:
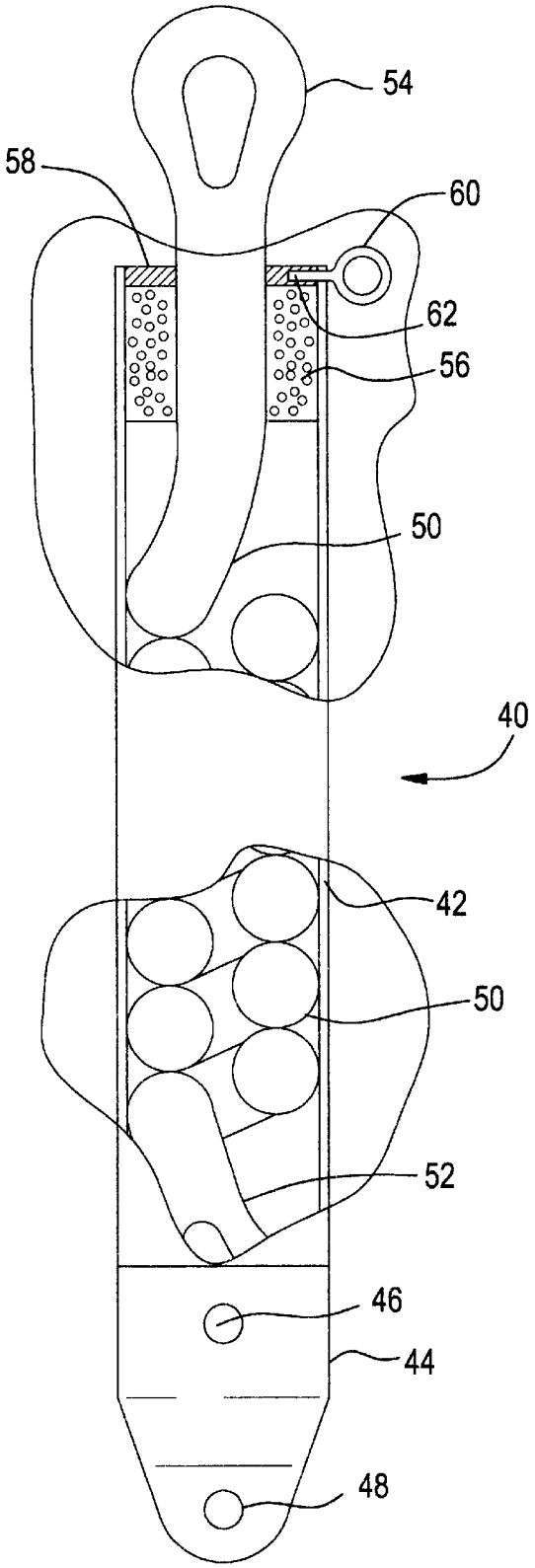
FIG. 3 is an external view of the emergency recovery system of the present invention with removed sections to show details of construction.

FIG. 3 is an external view of the emergency recovery system 40 with removed sections to show details of construction. Emergency recovery system 40 includes casing 42 with a generally rectangular cross section. Each end of casing 42 is open. One end of casing 42 has shackle 44 connected with cross pin 46. The outer end of shackle 44 has eye 48 for connection to a suitably positioned mating eye on the main stack 12 or lower marine riser package 14. Flexible sling 50 is disposed within casing 42. Flexible sling 50 has closed loops 52 and 54 formed on its ends. Flexible sling 50 is constructed of aramid fiber in the preferred embodiment but could be constructed of similarly flexible materials of sufficient strength without departing from the scope of the present invention.

Closed loop 52 of flexible sling 50 is retained within casing 42 by cross pin 46, thereby securing casing 42 and flexible sling 50 to blowout preventer stack 12 or lower marine riser package 14. Flexible sling 50 is fan folded within casing 42 to ensure proper deployment without tangling in a manner to be described hereinafter. Adjacent closed loop 54 is flotation member 56. Flotation member 56 is formed in two halves and connected around flexible sling 50. Retaining ring 58 is formed in two halves and secured about flexible sling 50 between flotation member 56 and closed loop 54. After flexible sling 50 is fan folded into casing 42, flotation member 56 and retaining ring 58 are inserted into casing 42. Release ring 60 is inserted through retainer hole 62 in casing 42 to retain flexible sling 50, flotation member 56 and retaining ring 58. Flotation member 56 is constructed of syntactic foam in the preferred embodiment but could be constructed of any suitably buoyant material that would cause flexible sling 50 to fully extend when release ring 60 is pulled. This buoyancy is based upon deployment in a subsea or similar liquid environment with a specific gravity substantially equal to one.

A typical sequence of operations for using the emergency recovery system 40 is as follows. A plurality of emergency recovery systems 40 are installed on the main stack 12 or lower marine riser package 14 in any orientation prior to deployment of the stack. If an emergency occurs while the blowout preventer stack 10 is on the ocean floor, the emergency recovery system 40 can be deployed. A remotely operated vehicle or "ROV" as it is known in the industry and well known to those of ordinary skill in the art, is guided by remote control to the main stack 12 or lower marine riser package 14. The manipulator arm of the ROV is used to pull release ring 60 from retainer hole 62 in casing 42. Since the flotation member 56 has sufficient buoyancy to overcome the weight of flexible sling 50, flexible sling 50 is pulled from casing 42 and extended to its full length. The ROV repeats this operation for the remaining emergency recovery systems 40. The ROV is then used to bring suitable tugging lines for attachment to the extended flexible slings 50.

The construction of our emergency recovery system will be readily understood from the foregoing description and it will be seen that we have provided an emergency recovery system that is compact and reliable and requires no diver intervention for proper operation.

Additionally, our emergency recovery system allows recovery of blowout preventer stacks and subsea trees with minimal damage to the recovered structure. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. An emergency recovery system, comprising:

a (plurality of) casing having first and second open ends;

a shackle connected to said first open end of said casing;

a flexible sling having first and second closed loops formed on the ends of said sling;

said sling having said first closed loop releasably connected to said shackle and said first open end of said casing;

said flexible sling having a flotation member attached to said sling adjacent said second closed loop; and, said flexible sling and said flotation member retained within said casing adjacent said second open end of said casing by releasable retention means.

2. An emergency recovery system according to claim 1, wherein said releasable retention means includes:

a retaining ring positioned around said sling between said flotation member and said second closed loop of said sling;

said retaining ring closely fitting within said second open end of said casing to retain said sling within said casing; and, said retaining ring retained within said second open end of said casing by a release ring.

3. An emergency recovery system according to claim 2, wherein:

said flotation member is sufficiently buoyant to cause said sling to extend substantially vertically from said casing in a subsea environment upon removal of said release ring.

4. An emergency recovery system according to claim 3, wherein:

said sling is positioned within said casing to facilitate extension of said sling when said release ring is removed.

5. An emergency recovery system according to claim 4, wherein:

said flotation member is constructed of syntactic foam.

6. An emergency recovery system according to claim 5, wherein:

said sling is constructed of aramid fiber.

7. An emergency recovery system according to claim 6, wherein:

said retaining ring is integrally formed with said flotation member.

* * * * *